United States Patent [19]

Kenkare

[11] 4,439,355

[45] * Mar. 27, 1984

[54] ELASTIC DETERGENT PRODUCT OF IMPROVED FOAMING POWER AFTER USE

[75] Inventor: Divaker B. Kenkare, South Plainfield, N.J.

[73] Assignee: Colgate-Palmolive Company, New York, N.Y.

[ * ] Notice: The portion of the term of this patent subsequent to Jun. 10, 1997 has been disclaimed.

[21] Appl. No.: 112,730

[22] Filed: Jan. 17, 1980

Related U.S. Application Data

[63] Continuation-in-part of Ser. No. 746,998, Dec. 2, 1976, Pat. No. 4,207,198.

[51] Int. Cl.[3] ..... C11D 17/00

[52] U.S. Cl. ..... 252/541; 252/153; 252/158; 252/545; 252/174; 252/132; 46/156; 106/125

[58] Field of Search ..... 252/542, 117, 545, 541, 252/132; 46/141, 156; 106/125, 131, 135

[56] References Cited

U.S. PATENT DOCUMENTS 3,689,437 9/1972 McLaughlin ..... 252/557

OTHER PUBLICATIONS

Chemical Abstracts, vol. 9/1136, 47/11885ob, 28/29729, 24/3694.

Veis, Macromolecular Chemistry of Gelatin, Academic Press, pp. 404–405.

*Primary Examiner*—John D. Welsh

*Attorney, Agent, or Firm*—Herbert S. Sylvester; Murray M. Grill; John A. Stemwedel

[57] ABSTRACT

An elastic detergent product of improved form-retaining ability during elevated temperature storage and of improved foaming power after use comprises an organic detergent which is an ammonium or lower alkanolammonium anionic organic detergent salt or a mixture of such anionic detergent with amphoteric synthetic organic detergent, gelatin and a lower di- or polyhydric alcohol. The products made, which are essentially free of water, or anhydrous, and often are of bar, cake or shaped article forms, are of improved thermal stability, allowing them to be stored at higher temperatures than comparable products, without distortion, and do not readily form inhibiting gel structures or coatings after use, which could otherwise diminish foaming power. Also within the invention is a method of making the described detergent products.

13 Claims, No Drawings

ELASTIC DETERGENT PRODUCT OF IMPROVED FOAMING POWER AFTER USE

This application is a continuation-in-part of my application, Ser. No. 746,998, entitled Elastic Detergent Product of Improved Foaming Power After Use, filed Dec. 2, 1976, which resulted in the issuance of U.S. Pat. No. 4,207,198 on June 10, 1980.

This invention relates to elastic detergent products. More particularly, it relates to such products intended for conventional toilet soap uses, either as hand "soaps" or bath or shower "soaps", which are elastic in nature, which include either anionic detergent(s) or mixtures of such detergent(s) and amphoteric synthetic organic detergent(s), gelatin and lower alkylene glycol or polyhydric alcohol, and which are essentially free of water. Products of such composition, usually in shaped article, bar or cake form, have been found to be more form stable on storage at elevated temperatures somewhat above normal storage temperatures and have been found to have a lesser tendency to form gels on standing between uses, which gels could otherwise inhibit foaming. The elastic detergent products of this invention are excellent foaming and detersive articles, readily generating foam when rubbed against the skin or worked between the hands and when alternately squeezed and released in bath or wash water. Their "squeezability" makes them useful playthings, as well as functional articles, thereby increasing children's pleasure in bathing.

A great many different materials hae been incorporated in soap and synthetic detergent products. It is well known that soap and detergent bars have long included perfumes, colorants, abrasives, bleaches, fillers, emollients and bodying agents, as well as many other aesthetic and functional components. Gelatin has been utilized as a bodying agent and while, because of its strong aqueous gels, it has been good in this respect, the present inventor has attributed to such gels a disadvantage noted in some gelatin-based detergent bars, which, after good initial foaming, can lose some of their foaming power. This is considered by him to be due to the hardened aqueous gelatin gel interfering with contact between the wash water and detergent in the bar. Soap bars have usually contained a lower polyhydric alcohol, such as glycerol, which is produced in the soap-making process, and such alcohols have also been suggested as components of gelatin based detergent bars.

U.S. Pat. No. 3,689,437 teaches the manufacture of malleable detergent products from certain percentages of a fatty acid isethionate, water, gelatin and hydrocarbon, with a filler being optionally present. The resulting bars, which may also contain glycerol or propylene glycol and other adjuvants, are said to be moldable and extrudable but not elastic. British Pat. No. 731,396 describes the manufacture of a shaped organic soapless detergent composition in which the organic soapless detergent, such as triethanolamine alkylbenzene sulfonate, is dispersed in a gelatin gel. Aeration of the gel to produce a frothy product is suggested, as are the additions of various builders, fillers, nonionic detergents, etc.

In U.S. Pat. No. 4,181,632, issued Jan. 1, 1980, to Frank Schebece, improved synthetic organic detergent products based on synthetic anionic detergent and cross-linked or denatured gelatin are described, as are detergent products based on amphoteric detergents, with or without such cross-linking and/or denaturing agent(s). In copending U.S. patent application Ser. No. 746,995, abandoned, entitled Elastic Detergent Bar Containing Anionic and Amphoteric Synthetic Organic Detergents, filed the same day as the parent application by Frank Schebece and John C. Carson, Jr., improved elastic detergent products which include mixtures of synthetic organic anionic and amphoteric detergents are described. In copending U.S. patent application Ser. No. 746,871, abandoned, entitled Elastic Detergent Bar of Improved Elevated Temperature Stability, filed the same day as the parent application by John C. Carson, Jr., and James M. Bowers, gasified, preferably aerated, elastic detergent products are described, based on mixed anionic and amphoteric detergents, which products, surprisingly, are of improved form-retaining ability at somewhat elevated storage temperatures.

The prior art has recognized that gelatin may be included in detergent compositions, which may then be desirably molded or shaped into bar or cake form, and the mentioned copending patent applications describe improved elastic detergent bars which may include gelatin and anionic and or amphoteric detergents. However, the present invention is of a further improvement of such types of products, which results in an increase in elevated temperature storage stability and helps to maintain high foaming power of the product during use. In accordance with the present invention a hand squeezable, elastic, solid molded detergent product of improved form retaining ability and foaming power after use, which is substantially free of water, comprises about 10 to 70% of an organic detergent or mixture of such detergents selected from the group consisting of ammonium and lower alkanolammonium anionic organic detergent salts and mixtures of such anionic organic detergent(s) and amphoteric synthetic organic detergent(s), about 8 to 35% of gelatin and about 20 to 65% of a lower pluralhydric alcohol selected from the group consisting of lower di- and polyhydric alcohols and mixtures thereof.

The anionic organic detergents of this invention comprise higher fatty acid soaps, often classified separately from synthetic organic detergents, and anionic synthetic organic detergents such as those which include sulfated, sulfonated and phosphonated hydrophobic moieties, especially those which contain higher hydrocarbyl groups (preferably fatty), such as alkyl groups of 8 to 20 carbon atoms, preferably of 10 to 18 carbon atoms. These compounds are usually employed as their ammonium or lower alkanolammonium (lower alkanolamine) salts, such as their triethanolamine and diethanolamine salts. However, in some cases, when the elastic detergent product characteristics are not detrimentally affected by their use, the alkali metal salts, such as the sodium and potassium salts, may be employed in conjunction with such lower alkanolamine or ammonium salts.

Among the various types of synthetic anionic organic detergents which may be useful in practicing the present invention are the higher fatty alcohol sulfates, such as the lower alkanolamine higher fatty ($C_{8-20}$) alcohol sulfates, e.g., triethanolammonium lauryl sulfate; monoglyceride sulfates, especially the sulfated monoglycerides of coconut oil, tallow, hydrogenated coconut oil, hydrogenated tallow and synthetic higher fatty acids of 8 to 20 carbon atoms, e.g., ammonium coconut oil monoglyceride sulfate (or ammonium cocomonoglyceride sulfate); linear higher alkylbenzene sulfonates, especially those of 12 to 15 carbon atoms in the alkyl group, e.g., ammonium linear tridecyl benzene sulfonate; paraffin sulfonates; olefin sulfonates; and corresponding and equivalent sulfates, sulfonates and phosphonates, in most of which the lipophilic group includes a chain of 8 to 20 or 10 to 18 carbon atoms. Additionally useful are the sulfates and sulfonates of nonionic detergents and of nonionic surface active agents, in which products the nonionic base will normally be a polyethylene oxide condensation product of a higher fatty alcohol, such as a condensation product based on a higher fatty alcohol of 10 to 18 carbon atoms, wherein the ethylene oxide content is from 3 to 30, preferably from 3 to 10 or 12 mols of ethylene oxide per mol of higher fatty alcohol, or of a poly-lower alkoxyalkyl phenol, wherein the alkyl is of about 3 to 20 carbon atoms, preferably of 8 to 18 carbon atoms and the poly-lower alkoxy group is of 3 to 30 lower alkoxy groups, preferably 7 to 15 ethoxy groups, such as triethanolammonium polyethoxydodecyl phenol sulfonate of about 11 ethoxy groups per mol. Specifically preferred anionic detergents include triethanolamine lauryl sulfate, ammonium cocomonoglyceride sulfate (coco indicates derivation of the fatty acid from coconut oils), triethanolammonium polyethoxydodecyl phenol sulfonate of 11 ethoxy groups per mol and diethanolammonium myristylethyl ether sulfate.

The higher fatty acid soaps, such as those of animal or vegetable fats and oils, tallow, coconut oil, hydrogenated tallows and coconut oils, may also be employed, usually as lower alkanolammonium soaps, such as triethanolamine stearate, and such soaps will normally be of higher fatty acids which have 8 to 20, preferably 10 to 18 carbon atoms. While it is possible to utilize alkali metal soaps and synthetic anionic detergent salts, such as those of sodium, such use should be carefully controlled so as to avoid the productions of synthetic organic detergent products (or soap or soap-detergent products) which do not have the desirable properties of the articles of the present invention. In the above descriptions of the anionic detergents lower alkanolamine is inclusive of alkanolamines of 1 to 3 carbon atoms in the amino portion, with 1 to 3, preferably 2 to 3 alkanols of 1 to 3 carbon atoms each, preferably 2 to 3 ethanols. The use of organic (and ammonium) salt forming cations, such as lower alkanolammonium, is highly preferred for both anionic and amphoteric detergents and such use is especially desirable when clear or translucent bars are to be made.

The amphoteric detergents which may be employed to manufacture the elastic detergent products of this invention, preferably in conjunction with the preferred anionic detergents, include, among others, imidazolinium betaines, iminodipropionates and aminopropionates. Normally, as with the anionic detergents, the water soluble salts will be utilized, either made in situ or charged to the composition mix during manufacture. Although acid forms of the amphoteric materials may be employed, the salts are preferable and although in some instances alkali metal salts or partial salts, such as the sodium salts, may be useful, the ammonium or lower alkanolammonium salts, such as the triethanolammonium salt, will normally be preferred. For example, such compounds as Deriphat ®160 (or Deriphat 160-C, an aqueous solution thereof), a partial sodium salt of N-lauryl-betaiminodipropionate, or Deriphat 151, a sodium N-coco-betaaminopropionate (both manufactured by General Mills, Inc.), may be used but usually it will be preferred to employ the triethanolamine salts. Although the triethanolamine (or triethanolammonium) salts are preferred, as with the anionic detergents, one may also use other lower alkanolamine salts, such as those of alkanolamines of 1 to 3 carbon atoms in the amino portion, with 1 to 3, preferably 2 to 3 alkanols of 1 to 3 carbon atoms each, preferably 2 to 3 ethanols. Other useful amphoterics, preferably also employed as the ammonium or lower alkanolammonium derivatives, are described in McCutcheon's *Detergents and Emulsifiers,* 1973 Annual, and in *Surface Active Agents,* Vol. II, by Schwartz, Perry and Berch (Interscience Publishers, 1958), the descriptions of which are incorporated herein by reference. The recited references also contain extensive descriptions of various suitable anionic detergents, and of nonionic and cationic detergents which may be employed in small proportion(s) in the present compositions. With respect to the amphoterics, for example, Deriphats 151-C, 154, 160, 160-C and 170-C, and Miranols ®$C_2M$, $S_2M$ and SHD Conc. may be employed. Additionally, even liquid amphoteric detergents may sometimes be used, at least in part, e.g., up to 25 or 50% of the total amphoteric detergent content. The various long chain substituents in the mentioned amphoterics are of 8 to 20 carbon atoms, preferably of 10 to 18 carbon atoms, and most preferably are lauryl and coco.

The nonionic detergents, while not required components of the invented products, may be present in relatively small porportions therein, usually in replacement of some of the anionic or amphoteric detergents. The nonionics are preferably solid or semi-solid at room temperature, more preferably solid, and include but are not limited to ethoxylated aliphatic alcohols having straight or branched chains (preferably being straight chain) of from about 8 to 20 carbon atoms, with about 3 to about 30 lower alkylene oxide units, preferably ethylene oxide units, per molecule, and ethoxylated hexitan esters, such as those of 20 or more lower alkoxy (usually ethoxy) groups per mol, which are higher fatty acid esters of sorbitan or mannitan, e.g., polysorbate 20 (polyoxyethylene sorbitan monolaurate). Such hexitan esters, based on polyoxyethylene and higher fatty acids of 10 to 18 carbon atoms, have long been manufactured by Atlas Chemical Industries and sold under the trademark Tween ®. Also useful are the nonionic detergents which are higher fatty alcohol polyethylene oxide condensates manufactured by Shell Chemical Company and marketed under the trademark Neodol ®. Of the various Neodols available, Neodol 25-7. (12–15 carbon atoms chain higher fatty alcohol condensed with an average of 7 ethylene oxide units per mol) and Neodol 45-11 (14–15 carbon atoms chain higher fatty alcohol condensed with an average of 11 ethylene oxide units per mol) are particularly preferred. Another suitable class of ethoxylated aliphatic alcohol detergents is made by Continental Oil Company and is sold under the trademark Alfonic ®. Of the Alfonics the most preferred is Alfonic 1618-65, which is a mixture of 16 to 18 carbon atoms primary alcohols ethoxylated so as to contain 65 mol percent of ethylene oxide. Additional examples of nonionic synthetic organic detergents include those marketed by BASF Wyandotte under the trademark Pluronic ®. Such compounds are made by condensation of ethylene oxide with a hydrophobic base formed by condensing propylene oxide with propylene glycol. The hydrophobic portion of the molecule has a molecular weight of from about 1,500 to 1,800 and the addition of polyoxyethylene (or ethylene oxide) to such portion increases the water solubility of the molecule as a whole, with the detergent being a solid at room temperature when the polyoxyethylene content is about 50% of the total weight of the condensation product. Such a nonionic detergent is Pluronic F-128 but Pluronic F-68 may also be employed. Also useful nonionic detergents are the polyethylene oxide condensates of alkylphenols, such as the condensation products of such compounds wherein the alkyl group contains about 6 to 12 carbon atoms, in either a straight chain or branched chain configuration, with 5 to 25 mols of ethylene oxide per mol of alkylphenol. The alkyl substituents in such compounds may be derived from polymerized propylene or may be diisobutylene, octene or nonene, for example.

Representative cationic detergents, which usually also possess antibacterial (and fabric softening) properties, include di-higher alkyl di-lower alkyl ammonium halides, such as distearyl dimethyl ammonium chloride, and 2-heptadecyl-1methyl-1-[(2-stearoylamido)ethyl]-imidazolinium methyl sulfate. The higher alkyls thereof are of 8 to 20 carbon atoms, preferably 12 to 18, and the lower alkyls are of 1 to 4 carbon atoms, preferably 1 and 2. Such materials are normally omitted from anionic detergent-based products but may be employed in small proportions when the amphoteric and nonionic detergent components of an elastic detergent bar constitute the major detergent proportion thereof and when the amount of anionic present is comparatively small, e.g., less than ¼ of the detergent.

Gelatin, a complex mixture of collagen degradation products of molecular weight in the range of about 30,000 to 80,000 (and higher), depending on the hydrolytic conditions to which it has been subjected, is a vital constituent of the present compositions. Apparently because of its outstanding ability to form reversible gels, its high viscosity and the excellent strengths of films thereof, it helps to make a solid elastic detergent product which is of satisfactory strength and cleaning power, due to gradual dissolution of the ordinarily extremely soluble synthetic detergent component, and yet, which does not produce objectionable and unacceptable soft gels at product surfaces which have been moistened. Additionally, and a major advantage of the present invention, the combination of gelatin and synthetic organic detergent, in the presence of lower dihydric or polyhydric (pluralhydric) alcohol, yields elastic products. The elastic detergent products made are sufficiently elastic so that a bar 2 cm. thick can be wetted and pressed between thumb and forefinger to a 1 cm. thickness and will immediately (within five seconds) return to the 2 cm. thickness or at least to within 1 mm. thereof, upon pressure release.

The gelatin employed is essentially colorless and free from odor. It is amphoteric (of about 45 milliequivalents of amino functions and about 70 milliequivalents of carboxyl functions per hundred grams thereof) It is normally used in formulating as a dry granular product which is crystalline in appearance although it is really amorphous. It is insoluble in cold water but swells rapidly in the presence of water until it has imbibed about 5 to 8 times its weight thereof and it melts to a viscous solution in water when warmed to above 40° to 45° C. Gelatins are classifed as either type A or type B, the former being from acid-cured stock, with an isoelectric point of about 8.3–8.5, and the latter being of alkali-cured stock, with an isoelectric point of about 4.8–5.0. Type A gelatins are preferred for the present applications but type B gelatins may also be used, as may be mixtures of the two. The gelling powers of gelatins are normally measured by the Bloom test. Often too, viscosity will also be employed to characterize a gelatin and a gel strength: viscosity ratio may be specified, e.g., 3:1 to 5:1. Gel strengths will range from 100 to 300 g. Bloom but will usually be in the range of 150 or 200 to 300 g. Bloom, with gelatins of Bloom values of 225 g. and 300 g. being employed in the examples herein. The type A gelatins will generally be utilized with the usual detergent bar constituents, normally intended for employment in neutral or slightly basic aqueous media, and the type B gelatins will be preferred when acidic conditions are expected to be encountered.

Cross-linking agents for gelatin and for otherproteins are metal salts which cross-link various gelatin molecules, apparently by reacting with free carboxyl functions thereof. This class of compounds is well known and the salts employed are usually those of aluminum, calcium, magnesium and/or zinc that are soluble in aqueous media. In such salts the preferred anions are chloride, bromide, iodide, sulfate, bisulfate and acetate but other suitable anions may also be included. Examples of such salts include potassium aluminum sulfate hydrate [alum, $KAl(SO_4)_2 \cdot 12H_2O$], other alums, aluminum chloride, calcium chloride, magnesium sulfate and zinc acetate. Also useful for cross-linking is formaldehyde, usually as formalin. 0.1 To 1% of formaldehyde is normally adequate. Although the presence of a cross-linking agent is often highly desirable in the formulations of the invented compositions, especially those based on anionic detergents, it has been found that such are not needed and sometimes may be objectionable in detergent products in which amphoteric detergents are the major detersive components.

Instead of or in addition to a cross-linking agent a denaturant may be employed with the gelatin of the present compositions. Such a compound also helps to reduce solubility of gelatin at and near its isoelectric point and inhibits crystallization. Although denaturation may be effected by various materials, including various detergents, ethanol, acetone, strong acids and strong alkalis, chemical denaturation, such as by urea, dextrose or guanidine hydrochloride, is preferred and of these denaturants urea is much preferred. Cross-linking and denaturation and the combination thereof are often helpful in producing a lastingly elastic detergent bar of desired properties, suitable for repeated and satisfactory cleaning applications.

The lower pluralhydric component(s) of the present elastic detergent products function(s) as a mutual solvent or dispersing medium for the product components, especially for the gelatin and detergents, and may also have a suitable plasticizing effect on the product. The detergent may be initially dissolved or dispersed in pluralhydric alcohol, such as propylene glycol, and may then have the same or different pluralhydric alcohol, such as glycerol, admixed with it during dissolving or dispersion of the gelatin and various other adjuvants. Surprisingly, the lower pluralhydric alcohols of this invention, without the presence of water, form satisfactory elastic detergent products in combination with the detergent and gelatin components. The only water present in the compositions will normally be that present as an impurity in components or obtained as a reaction product between components. Usually this will be less than 2% of the product, desirably less than 1% and more preferably less than 0.2%, with the completely or essentially anhydrous state being preferred. Often it is better for the moisture content to be limited to less than 1.5% and preferably less than 0.5%, with an even more preferable limit being less than 0.1%. Whether such moisture comes from components of the final composition, from the air or from water used to clean the equipment employed, limiting to such proportions results in improved structural stability of the product and improved foaming and cleaning characteristics thereof. During use the article may absorb moisture and hydrate the gelatin and if it is allowed to dry out completely between uses such can be detrimental to its foaming properties but it can continue to foam and clean satisfactorily, especially if it is not dried completely after such moisture pick-up. However, it is very important for the moisture content of the product to be limited initially, at the time of manufacture, especially so that during storage before first use a dehydrated gel structure will not be created, which could be expected to interfere with foaming and cleaning.

A variety of lower dihydric or polyhydric alcohols may be employed, including various sugars and sugar alcohols, having up to 6 carbon atoms and up to 6 hydroxyls per molecule, but the most preferred are those of 2 to 3 carbon atoms and 2 to 3 hydroxy groups per molecule. Such compounds include propylene glycol (1,2-dihydroxypropane or 1,2-propylene glycol), trimethylene glycol (1,3-propylene glycol) and glycerol, of which 1,2-propylene glycol, glycerol and mixtures thereof are preferred. Other useful solvents are the Cellosolves®, the mono- and di-lower alkyl ethers of ethlylene glycol. Additionally sometimes monohydric alcohols, such as ethanol, are useful, primarily as supplementary solvents.

Although elevated temperature stability and good foaming are obtained in the present elastic detergent products without finely divided insoluble gas bubbles therein, it is within the invention to make an improved elastic product of this invention with such gas bubbles homogenously dispersed therein. The insoluble gas employed is preferably air but may be any other gas which is substantially insoluble in the detergent bar mixture when such mix is in a fluid state and at an elevated temperature, and also when it is cooled. Thus, nitrogen, argon and other noble gases may be employed, as may be carbon dioxide, although the somewhat soluble carbon dioxide is not as desirable. The gas will usually be in small bubble form, with diameters usually being between 1 micron and 1 mm., and the bubbles will preferably be substantially homogeneously distributed throughout the product.

Additional desirable components of the present compositions include a fumed silica bodying agent, which also helps to diminish surface tackiness of the products. The fumed or pyrogenic silica may be a commercial fumed silica, such as Cab-O-Sil® M-5, wherein the particles are of colloidal sizes, such as in the 0.1 to 2 micron diameter range. Other pyrogenic and colloidal silicas may also be utilized, such as the Cab-O-Sils designated L-5 and SD-20, and comparable competitive compounds, all of which have high surface areas per unit weight, such usually being in the range of about 50 to 400 square meters per gram. In addition to or in replacement of the fumed silicas there may be present lower alkylene glycol higher fatty acid esters, for their surface detackifying effects. The lower alkylene glycol is normally ethylene or propylene glycol and the higher fatty acid is of 8 to 20 carbon atoms, preferably 10 to 18 carbon atoms, e.g., lauric acid, stearic acid. Compounds of this type have been found to minimize surface tackiness of the products made and this desirable result is noted with both non-aerated and aerated products of the present invention. The most preferred example of the lower alkylene glycol di-higher fatty acid esters is ethylene glycol distearate.

With the basic detergent type composition of this invention there may be present various adjuvant materials in minor proportions to contribute their particular properties to the final products. Among such adjuvant materials are functional and aesthetic adjuvants, such as: perfumes; pigments; dyes; optical brighteners; skin protecting and conditioning agents, e.g., lanolin, solubilized lanolin; bactericides, antioxidants; solvents; chemical stabilizers, e.g., sodium bisulfite; buffering agents and pH adjusters, e.g., triethanolamine, hydrochloric acid, phosphates; bodying agents, e.g., clays; superfatting agents, e.g., stearic acid; anti-redeposition agents and soil dispersants, e.g., polyvinyl alcohol, sodium carboxymethylcellulose; gums, e.g., sodium alginate, which also functions as a slip improving agent; and abrasive or scouring components, e.g., silex. Usually the present products do not and should not contain any fillers or builder salts other than those which may accompany, usually unavoidably, other components of the final product. However, in certain circumstances, as when bars are made for heavy duty laundry use, it may be desirable to add fillers, such as sodium sulfate and sodium chloride, and builder salts, such as pentasodium tripolyphosphate, sodium carbonate and sodium silicate. Particularly desirable builders are the phosphates, which may serve as buffers and also help to improve the surface condition of the product by counteracting any tendencies to exhibit tackiness. A preferred mixture of phosphates is one of mono-alkali metal phosphate and di-alkali metal phosphate, e.g., monosodium phosphate and disodium phosphate, in a ratio within the range of 1:5 to 5:1, preferably 1:4 to 1:2, but such materials are not of the excellent building effects of pentasodium tripolyphosphate.

The proportions and the various components of the present elastic detergent products should be kept within ranges to be given to obtain the best results, to produce a product which will be desirably elastic and useful in replacement of conventional soap, soap-detergent and detergent bars and which possesses improved properties, such as greater stability at elevated storage temperatures, better retention of foaming properties during use, a lesser tendency to slough when in contact with water, less tendency to shrink on storage, and improved surface (non-tacky) properties, compared to conventional soap, soap-detergent and/or detergent bars.

The synthetic organic detergent component, either anionic synthetic organic detergent or a mixture thereof with amphoteric synthetic organic detergent (proportions of nonionic and cationic detergents, if present, are recited separately) will be about 10 to 70%, preferably 30 to 60% of the bar. Thus, when an anionic detergent such as triethanolamine polyethoxyalkylphenol sulfonate (Cellopal® 100) is employed, the proportion thereof will generally be in the range of 35 to 55%, e.g., 40% to 50%. When mixtures of anionic and amphoteric detergents are utilized the more preferred total percentage will be 20 to 50% and the proportion of anionic detergent to amphoteric detergent will be in the range of 5:1 to 1:5, preferably 3:1 to 1:3 and more preferably 5:2 to 2:5. When the total content of anionic and amphomixture. Providing that foaming is minimized by the type of mixing employed, it appears that the presence of the detergent in the polyol aids in dissolving the gelatin. In some cases, it is preferable for a detergent to be employed as a solution in a polyol, for example, triethanolamine lauryl sulfate in propylene glycol, and sometimes another detergent, if present, such as amphoteric detergent, e.g., Miranol $C_2M$, may be dissolved in another polyol, e.g., glycerol, and the two detergent solutions may be mixed, after which the gelatin is dissolved in the mixture at elevated temperature.

The elastic detergent bars of this invention possess an important novelty advantage over ordinary soap or detergent bars. They are especially attractive to children when they are molded to special shapes, such as the shapes of storybook, fairy tale or cartoon characters, people, animals or objects, and promote the enjoyment of bathing by infants and young children. Because the product is elastic, such molded items seem more life-like or real to the young child. The elastic nature of the product also helps to allow a controlled dispensing of detergent and foaming materials and other utilization and aesthetic substances onto the skin or into the bath water in response to repeated squeezings and relaxings of the product. Thus, the utilitarian detergent article is also an interesting toy. However, the product has various other advantages apart from its play value. The presence of gelatin adds a skin care ingredient to the composition and because of the product's elasticity, breakage in shipment or during storage is minimized. Furthermore, large quantities of detergent may be present in the composition without the need for extensive use of expensive waxes, special plasticizers, bodying agents, etc., to control the dissolvings of the articles and to give them desirable tactile properties and good appearances. The products do not slough excessively, as often do ordinary detergent and soap bars and additionally, they maintain substantially their original shapes during use, continually dispensing detergent when rubbed onto the skin, worked in the hands or repeatedly compressed and relaxed. Of paramount importance with respect to the present invention are the continued good foaming properties of the present products during use, despite a tendency that has been noted for some gelatin-containing detergent bars to foam poorly after several uses. Thus, the invented articles can be used for a usual minimum of several hundred washings (100 g. bar) or ten or more baths (150 g. bar) or proportionate combinations thereof. Also important is the elevated temperature stability of the invented products, which allows them to be shipped and stored at temperatures above 45° or 50° C. without undue deformation due to softening. Although the present products can be transparent they may also be opacified by the inclusion of insoluble materials, such as the pyrogenic silicas and clays (or air). They can be made floating by the incorporation of air or other gas bubbles therein and such floating products will often possess the additional advantage of more rapidly generating foam when repeatedly squeezed and relaxed.

It is to be understood that within the proportions of components given variations may be made to best promote desired properties of the articles manufactured and similarly, processing modifications may also be effected. Thus, proportions of gelatin, detergents, cross-linking agents, denaturants, pluralhydric alcohols, pyrogenic silica and other adjuvants may be adjusted, as may be the types of such materials. For example, if the product is too soft an increase in the solids content, especially in the gelatin content, may be desirable and the gelatin type may be changed to that of higher Bloom value to increase firmness. Those of skill in the art, with this specification before them, will be able to modify the properties of the described compositions and articles within the bounds of this description to make them conform to desirable product standards and similary, will also be able to modify the processes.

The following examples illustrated but do not limit the invention. Unless otherwise indicated all temperatures are in °C. and all parts are by weight.

EXAMPLE 1

| | Percent |
|---|---|
| Gelatin (300 g. Bloom, Type A) | 20.0 |
| 1-Carboxymethyl-1-carboxyethoxyethyl-2-coco-imidazolinium betaine (Miranol $C_2M$, anhydrous acid, mfd. by Miranol Chemical Company) | 8.4 |
| Triethanolamine | 3.0 |
| Glycerol | 40.1 |
| Triethanolammonium lauryl sulfate solution (65% TEALS in propylene glycol, sold as Maprofix TLS-65 by Onyx Chemical Co.) | 20.0 |
| Polyoxyethylene sorbitan monolaurate (20 mols of ethylene oxide per mol, sold as Tween 20 by Atlas Chemical Industries) | 5.0 |
| Cab-O-Sil M-5 (fumed silica, manufactured by Cabot Corp.) | 3.0 |
| Perfume | 0.5 |
| | 100.0 |

A "Lightnin" mixer is employed to stir all the above components except the fumed silica and perfume at a constant high speed at a temperature of about 85° C. until all of the gelatin has been dissolved, which takes about 25 minutes. The fumed silica is then dispersed in the mix and finally, after cooling to a temperature below 60° C., the perfume is mixed in and the composition is poured into molds, which have been pre-cooled to a temperature of 10° C., and in them the mix temperature is lowered to about 15° C., at which it is completely solidified to desired product form. After solidification the elastic detergent products are withdrawn from the molds and are packed and stored, ready for shipment.

Samples of the products are tested and are found to be of good foaming characteristics, elastic in nature and capable of repeatedly foaming during normal repeated handwashing and bath uses despite being wetted and dried out several times. Additionally, the products are of an improved elevated temperature stability, compared to other gelatin-detergent bars, being sufficiently stable at a temperature of 51° C. to maintain their shapes during storage before use, during which storage the products are subjected to such temperature. Furthermore, the products made are of attractive elastic condition, returning readily to initial shape after elastic deformation in the squeezing test previously described, and are good detergents. They are not objectionably tacky on the surfaces thereof nor are they objectionably hard or soft. They essentially retain their original molded forms during use and, probably because of their elasticity, resist breakage during shipments.

In a modification of the desired formula the proportion of Miranol $C_2M$ is increased to 11.2%, the proportion of triethanolamine (to form the salt of the Miranol teric detergents is less than about 20% there will normally be sufficient nonionic detergent present to raise the total of anionic, amphoteric and nonionic detergent to at least 20% in the detergent bar. The gelatin, preferably type A gelatin of 225 to 300 g. Bloom, will be about 8 to 35% of the bar, preferably about 12 to 30% or 15 to 25% thereof. The lower pluralhydric alcohol content will be from about 20 to 65% of the bar, preferably 20 to 55% or 20 to 50% thereof. Nonionic surface active agent content, including nonionic detergent content, will normally be in the range of 1 to 25%, when present, and will preferably be 5 to 20%. When a cross-linking agent and/or a denaturant is present the proportion thereof will usually be about 0.1 to 5%, preferably about 0.7 to 2%. The proportion of fumed silica or similar bodying agent will generally be in the range of 1 to 5%, preferably 2 to 4% and the proportion of phosphate buffering agent, if present, will usually be from 0.5 to 4%, preferably 0.7 to 2%. The total of any other adjuvants present, including building and fillers, will normally not exceed 20% or 10%, preferably being less than 5% and more preferably being less than 2%, with the proportion of any particular adjuvant usually being less than 10 or 5%, preferably less than 2% and more preferably less than 1%. Particular preferred elastic detergent products of this invention comprise from 20 to 60% of triethanolammonium polyethoxyalkylphenol sulfonate, 15 to 25% of gelatin and 20 to 55% of glycerol; 20 to 60% of triethanolammonium higher fatty alcohol sulfate, 15 to 25% of gelatin and 20 to 55% of a mixture of glycerol and propylene glycol in a ratio in the range of 5:1 to 1:2; 8 to 40% of triethanolammonium higher fatty alcohol sulfate, 5 to 30% of triethanolammonium 1-carboxymethyl-1-carboxyethoxyethyl-2-coco-imidazolinium betaine, 15 to 30% of gelatin and 20 to 65% of pluralhydric alcohol; 10 to 25% of triethanolammonium lauryl sulfate, 7 to 20% of triethanolammonium 1-carboxymethyl-1-carboxyethoxyethyl-2-coco-imidazolinium betaine, 15 to 25% of gelatin, 20 to 50% of glycerol, 5 to 20% of propylene glycol, 1 to 10% of nonionic surface active agent (polyoxyethylene sorbitan monolaurate or a cocomonoethanolamide or mixture thereof) and about 1 to 5% of fumed silica; and 2 to 15% of myristyltriethoxy diethanolamine sulfate, 3 to 15% of triethanolammonium 1-carboxymethyl-1-carboxyethoxyethyl-2-coco-imidazolinium betaine, 10 to 20% of polyoxyethylene sorbitan monolaurate, 3 to 15% of cocodiethanolamide, 15 to 30% of gelatin and 40 to 60% of glycerol. Mixtures of various materials within the classifications mentioned above may be employed in place of single pure materials and it is contemplated that technical chemicals containing relatively small percentages of impurities will be utilized, as well as those which are chemically pure. Within the percentage and proportion ranges given satisfactory elastic detergent products of improved elevated temperature storage stability and improved continued foaming power are obtainable and with the present specification as a guide, one of skill in the art will be able to adjust the various percentages and proportions within the ranges given so as to make the most satisfactory products. However, when percentages or proportions outside the ranges and ratios recited are utilized less desirable products will result, such articles often being of poorer elevated temperature stability, poorly foaming, tacky, excessively firm or soft, inelastic (possibly being malleable instead), subject to excessive shrinking and syneresis or weeping, or otherwise being unacceptable commercially. On the contrary, the detergent articles of this invention are satisfactorily elastic, do not shrink or weep excessively, are neither unduly soft nor too firm, are of improved elevated temperature storage stability and continuing foaming power during use and are useful attractive detergent products. They foam well in response to repeated compressions and relaxations and when rubbed against areas to be cleansed. They have a different "feel" from that of soap when contacting the skin and the better contact obtained assists in cleaning. The detergents in the bars, cakes or other shaped articles are readily released at temperatures of 25° to 40° C. and higher. For cold water washing, at lower temperatures, especially 10° C. and less, more soluble and lower Bloom value gelatins can be employed, with appropriate solvents and adjuvants, to help release the detergent.

The manufacture of the invented detergent product is comparatively simple and involves the mixing together of the various components under such conditions that the gelatin will form a satisfactory gel with the lower pluralhydric alcohol and detergent and any other product components present. For example, all the components of a particular detergent product composition may be mixed together and heated, with stirring, to dissolve the gelatin or the gelatin may be first dispersed and dissolved in the pluralhydric alcohol and the other components may then be admixed with the dispersion-solution. Similarly, other operative mixing methods may be adopted, a preferred sequence of which will be described later. The temperature to which the medium may be heated to assist in dissolving the gelatin will preferably be in the 80° to 100° C. range. After the gelatin and all other soluble components of the bar composition are dissolved, which will usually take from 3 to 20 minutes, the mix will be poured into suitable cooled molds, which are usually at a temperature of 5° to 30° C., preferably 5° to 20° C., in which it is cooled to a temperature of about 5° or 10° to 25° or 30° C., preferably 5° to 20° C., to completely set the gelatin composition, which may take from about 1 minute to an hour, usually taking from 3 to 20 minutes. Then the elastic detergent articles may be removed from the molds and may be packed or may be allowed to warm to room temperature before packing, at which temperature they still remain firm, yet elastic. If desired, rather than pouring the hot mixture directly into molds, it may be cooled to an intermediate temperature, e.g., 30° to 60° C. and a gas, preferably air, may be mixed with the gel to form finely divided bubbles therein, utilizing a mechanical mixer, such as a Lightnin® or Eppenbach® homogenizing mixer or a diffuser, injector, distributor, aerator or other means to incorporate gas in the gel. After addition of the gas in bubble form, the volume of the mix will usually be increased about 5 to 60%, preferably 10 to 50%, so that the product made will have a density lower than that of water, usually being in the range of about 0.5 to 0.98 g./cc., preferably 0.65 to 0.9 g./cc. Next, the gasified mixture may be poured into the suitable cooled molds and set, as previously described. Heat sensitive components of the final product may also be admixed with the gel solution as it is being cooled, before final setting.

Although the detergent-gelatin-polyol mixture may be made by various ways, as described above, it is preferred to dissolve the detergent(s) in the polyol(s) and then, at an elevated temperature, e.g., 80° to 100° C., preferably 90° to 99° C., dissolve the gelatin in such imidazolinium betaine) is increased to 4.0%, the percentage of glycerine is reduced to 29.0% and that of the triethanolammonium lauryl sulfate solution is increased to 33.3%. Also, the Tween 20 is replaced by 2% of cocomonoethanolamide and the fumed silica is omitted from the formula. The manufacturing method is the same as previously described, with the cocomonoethanolamide being included in the original mixture and with the perfume being added after preliminary cooling. The products resulting are higher in detergent content and are better foaming and detersive products but otherwise are of properties similar to those previously described in this example.

In the above modified formula the percentage of cocomonoethanolamide may be increased to 5%, with the additional 3% replacing glycerol, and an even better foaming product is obtained. Similarly, such replacements may be with lauric myristic diethanolamide and other such higher fatty acid ($C_{8-20}$) lower ($C_{1-3}$) mono- or dialkanolamides. Such compounds are often considered to be foam stabilizers or enhancers but also have detersive properties and in this specification are considered within the description of nonionic detergents, given previously, as are amine oxides of the usual types.

In variations of the above formulations and manufacturing methods, after mixing the various components, except perfume, the temperature of the mix is lowered to 60° C., at which temperature the perfume is blended in and air is intentionally beaten into the mixture over a period of five minutes, so as to increase the mix volume about 50%, after which the mix is poured into molds, as previously described. The product resulting, when cooled, is of a density of about 0.7 to 0.8 g./cc. The properties thereof are similar to those for the unaerated products previously described except that elevated temperature stability is further improved and the products float in water. In another modification of the manufacturing method, to avoid the presence of any bubbles in the final product, the mix is allowed to remain quiescent for about ten minutes at 60 to 70° C., after perfume addition and before molding, to permit any dispersed air or gas bubbles to rise within it and be "vented" to the atmosphere. In still another manufacturing method the technique described in the specification before these examples may be employed, with the Tween 20, Cab-O-Sil M-5 and perfume being omitted from the formula, and with the Miranol $C_2M$ and the triethanolamine being dissolved in the glycerol and being mixed with the TEALS in propylene glycol, at an elevated temperature, e.g., 92° C., after which the gelatin is mixed therewith. Alternatively, the glycerol may be mixed with the solution of TEALS and the Miranol $C_2M$ and triethanolamine may then be admixed, followed by dissolving of the gelatin. Such procedures appear to result in better and quicker dissolving of the gelatin, compared to those wherein it is initially attempted to dissolve it in glycerol or propylene glycol alone, followed by addition of the detergent materials.

The various elastic detergent products described above all have moisture contents less than 1% and several of them have less than 0.1% of moisture therein. They all conform well to body surfaces, feel especially good against the skin and leave it feeling soft.

EXAMPLE 2

| | Percent |
|---|---|
| Gelatin (300 g. Bloom, Type A) | 20.0 |
| Glycerine (dental grade) | 29.5 |
| Cellopal 100 (polyethoxy [11 mols per mol] dodecyl phenol sulfonate, triethanolamine salt, sold by Tanatex Chemical Corp.) | 50.0 |
| Perfume | 0.5 |
| | 100.0 |

The glycerine is heated to 88° C. and the gelatin powder is sprinkled into it, with stirring until the gelatin is dissolved, which takes about 50 minutes. Then the Cellopal 100 is mixed in for a period of about 12 minutes, after which the perfume is added, with the temperature at about 65° C., and the product is molded, as described in Example 1.

The elastic detergent products made are readily removed from the molds and are good foaming throughout repeated uses with intermediate dryings. They are not objectionably tacky on the surfaces thereof, are of improved and acceptable elevated temperature stability, are satisfactorily elastic, being neither too hard nor too soft and, when molded in particular forms, such as cartoon characters, maintain such shapes for substantial proportions of their useful lives, despite repeated uses.

In a modification of this example, when the proportion of Cellopal 100 is decreased to 40% and that of glycerine is increased to 39.5% the product is somewhat softer and the foaming action is not as great, although the article is acceptable in both respects. Otherwise, it is similar to that described earlier in this example.

EXAMPLE 3

| | Percent |
|---|---|
| Gelatin (300 G. Bloom, Type A) | 20.0 |
| Glycerol | 28.5 |
| Maprofix TLS-65 (65% triethanolamine lauryl sulfate in 35% of propylene glycol, sold by Onyx Chemical Company) | 33.3 |
| Sodium bisulfite | 0.5 |
| Cocomonoethanolamide | 2.0 |
| Miranol $C_2M$, triethanolamine salt | 15.2 |
| Perfume | 0.5 |
| | 100.0 |

The sodium bisulfite and gelatin are dissolved in the glycerine and Maprofix mixture by heating at a temperature of 88° C. for about 45 minutes, after which a mixture of the cocomonoethanolamide and Miranol $C_2M$, triethanolamine salt, is added and mixed in over a period of the ten minutes and the perfume is mixed in over one minute. The bisulfite is utilized to stabilize the color of the product. The composition is molded as described in previous examples. The products made have the properties previously described for those of Example 1 and 2 and when gasified by the methods previously described produce similar low density bars. When the formula is modified by increasing the glycerol content to 29.5%, adding 1.5% of triethanolamine stearate (reacting stearic acid with triethanolamine) and omitting the sodium bisulfite and the cocomonoethanolamide, satisfactory elastic detergent products are made. In the manufacturing method employed the glycerol is heated to 83° C., the stearic acid is dissolved in it with stirring over a period of about five minutes, the triethanolamine, Maprofix TLS-65 and Miranol $C_2M$, triethanolamine salt (as Miranol $C_2M$ and triethanolamine) are dissolved in the glycerol-stearic acid melt over a period of about five minutes and the gelatin is dissolved in the resulting mixture over a period of about 50 minutes, after which perfume is added in about one minute. The composition made is molded according to the methods previously described and the product obtained has good characteristics, like the elastic detergent products of previous examples. It is easy to pour into molds, easy to remove from them, of good elevated temperature stability, of good repeated foaming properties, satisfactorily elastic, nontacky and of desirable hardness and stability.

EXAMPLE 4

| | Percent |
|---|---|
| Coco fatty acid mixture (average molecular weight of 218) | 22.5 |
| Stearic acid (molecular weight of 268) | 7.9 |
| Triethanolamine | 16.7 |
| Glycerol | 26.9 |
| Maprofix TLS-65 (dehydrated) | 5.0 |
| Sodium bisulfite | 0.5 |
| Gelatin (300 g. Bloom, Type A) | 20.0 |
| Perfume | 0.5 |
| | 100.0 |

The coco fatty acid and stearic acid, in mixture, are heated to a temperature of 82° C. for five minutes and then the triethanolamine is added to form the corresponding soaps. After mixing for another five minutes the glycerol and the Maprofix TLS-65 are added and after an additional five minutes mixing the sodium bisulfite and gelatin are added over a period of fifteen minutes, after which the mix is maintained at 82° C. for an additional 30 minutes. Finally, after cooling to about 65° C. the perfume is added and stirred in for one minute. The mix does not aerate and does not require any deaeration. It is easy to pour and the molded articles, made as described in the foregoing examples, are easy to remove from the molds. The products made are good foaming articles, bars or cakes, repeatedly foam during use, exhibit improved elevated temperature stability, are not objectionably tacky on the surfaces thereof, are of desirable hardness (not unduly hard or soft), are satisfactorily elastic and are good detergents.

EXAMPLE 5

| | Percent |
|---|---|
| Glycerol | 58.8 |
| Miranol $C_2M$, triethanolamine salt | 15.2 |
| Tween 20 | 5.0 |
| Gelatin (300 g. Bloom, Type A) | 20.0 |
| $NaHSO_3$ | 0.5 |
| Perfume | 0.5 |
| | 100.0 |

A mixture of glycerol, Miranol $C_2M$, TEA salt and Tween 20 is heated to 90° C. with moderate stirring and after about five minutes to it are added the $NaHSO_3$ and gelatin over a period of about fifteen minutes, after which the mixer speed is increased and heating and stirring are continued for an additional half hour. The mix is cooled to 70° C. and perfume is added, with stirring, over a period of about 1½ minutes. The product is molded as previously described.

As with the products of the previous examples, this one is a satisfactory elastic detergent article of good elevated temperature stability and good foaming and refoaming powers.

EXAMPLE 6

| | Percent |
|---|---|
| Glycerol (dental grade) | 48.4 |
| Standapol ® Conc. 7023 (equal proportions of cocodiethanolamide and diethanolamine myristyl triethoxy sulfate, anhydrous, made by Henkel et Cie.) | 8.0 |
| Tween 20 | 15.0 |
| Miranol $C_2M$, triethanolamine salt | 7.6 |
| $NaHSO_3$ | 0.5 |
| Gelatin (300 g. Bloom, Type A) | 20.0 |
| Perfume | 0.5 |
| | 100.0 |

The glycerol, Standapol, Tween, Miranol and TEA (stoichiometric amount to neutralize 5.6% of Miranol $C_2M$, anhydrous) are mixed together and heated to a temperature of 90° C., after which the $NaHSO_3$ and gelatin are admixed over a period of 15 minutes, with the stirring being conducted at moderate speed. Subsequently, the stirring speed is increased and mixing is continued for ½ hour to dissolve the gelatin. Then the mix is cooled to 75° C. and perfume is added over a period of 1.5 minutes, with stirring. The composition is then poured into molds, as previously described. The product is an excellent elastic detergent article of good foaming and re-foaming power, is of improved elevated temperature stability, is easy to remove from the molds and is non-tacky.

EXAMPLE 7

| | Percent |
|---|---|
| Glycerol | 38.8 |
| Standapol Conc. 7023 | 25.0 |
| Miranol $C_2M$, triethanolamine salt | 15.2 |
| $NaHSO_3$ | 0.5 |
| Gelatin (300 g. Bloom, Type A) | 20.0 |
| Perfume | 0.5 |
| | 100.0 |

The procedure of Example 6 is repeated with the glycerol, Standapol and Miranol being first admixed and heated, the $NaHSO_3$ and gelatin being added and dissolved and the perfume being added to the partially cooled mix, followed by molding. The product is a satisfactory elastic detergent article of good foaming and re-foaming characteristics, of improved elevated temperature stability and of satisfactory tactile properties and appearance.

When in the preceding examples the 300 g. Bloom Type A gelatin is replaced with 1.2 times as much of 225 g. Bloom Type A gelatin or with a corresponding quantity of Type B gelatin of the same Bloom value, useful elastic detergent products result, although Type A gelatins are highly preferred to produce the best bars. Also, when instead of the Miranol $C_2M$ salt there are substituted in the preceding formulations other lower alkanolamine salts, e.g., diethanolammonium salts, and Deriphats 151 and 160, similar useful products result. This is also the case when triethanolamine lauryl sulfate, triethanolamine stearate, triethanolamine cocate-stearate, Cellopal 100, the alkyl sulfate of Maprofix TLS-65, Tween-20, cocomonoethanolamide, cocodiethanolamide and Standapol Conc. 7023 are replaced by others of the named anionic detergents and nonionic detergents, respectively. Furthermore, replacements with the other mentioned detergents of the same anionic, amphoteric and nonionic types result in similarly acceptable products of desirable characteristics, especially when the formulations made are produced with the guidance of the present specification. Likewise, variations in the proportions of the various components to ±10%, ±20% and ±25% of the amounts given in the working examples produce acceptable and satisfactory elastic detergent articles of desirable characteristics when such proportions are within the ranges specified herein.

The invention has been described with respect to various illustrations and embodiments thereof but is not to be limited to these because it is evident that one of skill in the art with the present specification before him will be able to utilize substitutes and equivalents without departing from the spirit of the invention.

What is claimed is:

1. A hand squeezable, elastic, solid molded detergent product of improved form-retaining ability and foaming power after use, which is sufficiently elastic so that a 2 centimeter thickness thereof can be pressed between a thumb and forefinger to a 1 cm. thickness and upon release of such pressure will return within five seconds to within 1 mm. of the 2 cm. thickness, which comprises about 10 to 70% of an organic detergent or mixture of such detergents selected from the group consisting of ammonium and lower alkanolammonium anionic organic detergent salts and mixtures of such anionic organic detergent(s) and amphoteric synthetic organic detergent(s), about 8 to 35% of gelatin and about 20 to 65% of a lower pluralhydric alcohol selected from the group consisting of lower di- and polyhydric alcohols and mixtures thereof, and which is substantially free of water.

2. An elastic detergent product of improved form retaining ability and foaming and cleaning power after use, which is sufficiently elastic so that a 2 centimeter thickness thereof can be pressed between the thumb and forefinger to a 1 cm. thickness and upon release of such pressure will return within five seconds to within 1 mm. of the 2 cm. thickness, which is initially substantially free of water and comprises a detersive quantity of organic detergent, a gelling and bodying content of gelatin and sufficient lower pluralhydric alcohol to act as a solvent and gelling medium for the detergent and gelatin, with the proportions of the named components present being such as to produce a solid elastic detergent product.

3. An elastic detergent product according to claim 1 wherein the moisture content is less than 2%.

4. An elastic detergent product according to claim 3 wherein the moisture content is less than 1.5%.

5. An elastic detergent product according to claim 4 wherein the moisture content is less than 0.5%.

6. An elastic detergent product according to claim 5 wherein the anionic organic detergent salts are selected from the group consisting of higher fatty alcohol sulfates, higher fatty acid monoglyceride sulfates, linear higher alkyl benzene sulfonates, paraffin sulfonates, olefin sulfonates, higher fatty alcohol polyethylene oxide condensation product sulfates, higher fatty alcohol polyethylene oxide condensation product sulfonates, poly-lower alkoxy alkyl phenol sulfates, poly-lower alkoxy alkyl phenol sulfonates, and higher fatty acid soaps, and mixtures thereof, and the amphoteric detergents are selected from the group consisting of betaamino propionates, betaimino dipropionates and imidazolinium salts, and mixtures thereof.

7. An elastic detergent product according to claim 5 wherein the moisture content is less than 0.2%.

8. An elastic detergent product according to claim 7 which is anhydrous.

9. An elastic detergent product according to claim 1 wherein the organic detergent is an anionic organic detergent or a mixture of such detergents, the gelatin is of 100 to 300 g. Bloom and the pluralhydric alcohol is one of 2 to 3 carbon atoms and of 2 to 3 hydroxyls per mol or a mixture thereof.

10. An elastic detergent product according to claim 1 wherein the organic detergent is a mixture of anionic organic detergent(s) and amphoteric synthetic organic detergent(s), the gelatin is of 100 to 300 g. Bloom and the pluralhydric alcohol is one of 2 to 3 carbon atoms and of 2 to 3 hydroxyls per mol or a mixture thereof.

11. An elastic detergent product according to claim 1 wherein the organic detergent is a mixture of triethanolammonium lauryl sulfate and triethanolammonium 1-carboxymethyl-1-carboxyethoxyethyl-2-coco-imidazolinium betaine and the lower pluralhydric alcohol is a mixture of glycerol and propylene glycol.

12. An elastic detergent product according to claim 2 wherein the organic detergent is a mixture of triethanolammonium lauryl sulfate and triethanolammonium 1-carboxymethyl-1-carboxyethoxyethyl-2-coco-imidazolinium betaine and the lower pluralhydric alcohol is a mixture of glycerol and propylene glycol.

13. An elastic detergent product according to claim 1 wherein the anionic organic detergent salts are selected from the group consisting of higher fatty alcohol sulfates, higher fatty acid monoglyceride sulfates, linear higher alkyl benzene sulfonates, paraffin sulfonates, olefin sulfonates, higher fatty alcohol polyethylene oxide condensation product sulfates, higher fatty alcohol polyethylene oxide condensation product sulfonates, poly-lower alkoxy alkyl phenol sulfates, poly-lower alkoxy alkyl phenol sulfonates, and higher fatty acid soaps, and mixtures thereof, and the amphoteric detergents are selected from the group consisting of betaamino propionates, betaimino dipropionates and imidazolinium salts, and mixtures thereof.

* * * * *